United States Patent [19]

Tal et al.

[11] Patent Number: 4,702,171

[45] Date of Patent: Oct. 27, 1987

[54] HOLLOW CHARGES

[75] Inventors: Reuven Tal, Kiron; Dov Chaiat, Kfar Saba; Eitan Hirsch, Netanya, all of Israel

[73] Assignee: The State of Israel, Ministry of Defence, Israel Military Industries, Israel

[21] Appl. No.: 878,621

[22] Filed: Jun. 26, 1986

[30] Foreign Application Priority Data

Dec. 12, 1985 [IL] Israel ..... 77309

[51] Int. Cl.[4] ..... F42B 11/22

[52] U.S. Cl. ..... 102/476; 102/307

[58] Field of Search ..... 102/306–310, 102/476

[56] References Cited

U.S. PATENT DOCUMENTS

| | | | |
|---|---|---|---|
| 3,135,205 | 6/1964 | Zweck | 102/476 X |
| 3,235,005 | 2/1966 | Delacour | 102/306 |
| 4,498,367 | 2/1985 | Skolnick et al. | 102/306 |

FOREIGN PATENT DOCUMENTS

| | | | |
|---|---|---|---|
| 131701 | 3/1949 | Australia | 102/476 |
| 1128345 | 4/1962 | Fed. Rep. of Germany | 102/476 |
| 360315 | 3/1962 | Switzerland | 102/476 |

*Primary Examiner*—Harold J. Tudor

*Attorney, Agent, or Firm*—Steinberg & Raskin

[57] ABSTRACT

A shaped charge bomb whose liner is partially coated with a metal whose density is greater than that of the liner which coating extends from an inner end on a circumferential line of the liner that results from the intersection of the inner side of the liner with a notional cylinder coaxial with the liner and having a radius not exceeding R/4 where R is the inner radius of the liner, the thickness of the heavy metal coating at each point meeting the equation $$T_c \cdot \rho_c / \sin \frac{2\beta}{2} < T_1 \cdot \rho_1 / \cos \frac{2\beta}{2}$$

where $T_c$ is the coating thickness at a given circumferential line x, $T_1$ is the liner thickness, $\rho_c$ is the coating density, $\rho_1$ is the liner density and $\beta$ is the collapse angle at the circumferential line x.

6 Claims, 7 Drawing Figures

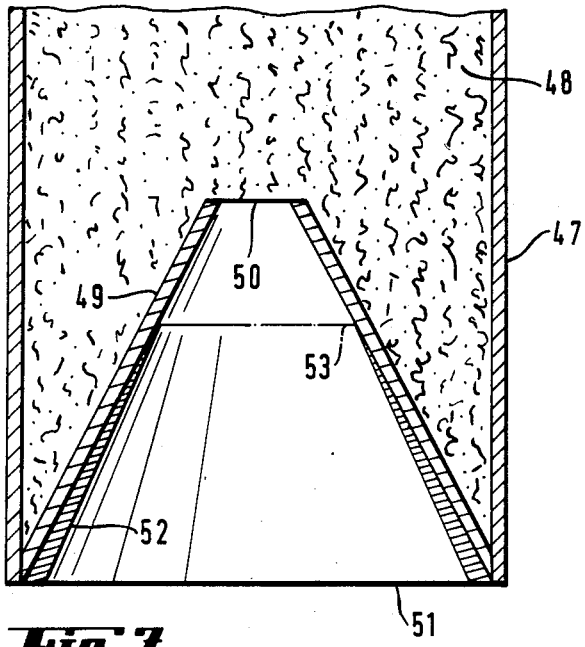
Fig. 7
Fig. 6
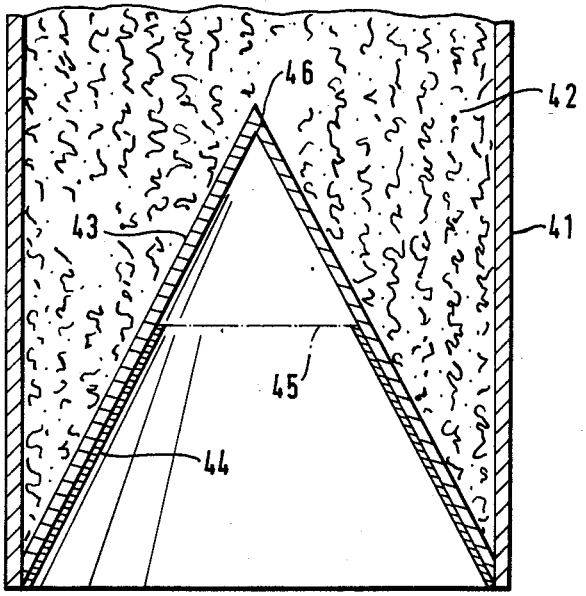

HOLLOW CHARGES

FIELD OF THE INVENTION

The present invention concerns bombs comprising a so-called shaped or hollow charge and aims at improving the performance of the liner thereof. The bombs with which the present invention is concerned may be mortar or gun shells, self-propelled rockets, bombs dropped from an aircraft and quite generally any kind of bomb that flies to its target.

GLOSSARY

In the present specification and claims:

"inner side" of a liner means the side that is turned away from the shaped explosive charge of the bomb;

"tip velocity" means the velocity of the front part of the coherent, forward bursting jet formed by the liner upon detonation of the shaped charge;

"break-up time" means the time interval until a forward bursting, coherent jet formed by the liner upon detonation of the shaped charge breaks up into segments;

"stand-off" means the distance between the warhead tip of the bomb and the front end of the liner of the shaped charge thereof;

"collapse angle" means the angle between the axis of symmetry of the liner and the outer imploding liner surface as shown in FIG. 2 herein (see also Eitan Hirsch, J. Appl. Phys. 50 (7), July 1979; and E. Hirsch, Propellants and Explosives 4, 89–94 (1979)).

BACKGROUND OF THE INVENTION

Shaped charge bombs comprise a shaped charge warhead section, e.g. of conical or frusto-conical shape, that spreads axially symmetrically from an inner apex or a narrow end to the front end (base) having as a rule the same diameter as the explosive charge. Liners in hollow charge warheads are made of ductile metals such as copper, aluminium, magnesium, tin, zinc, titanium, nickel, iron, zirconium, silver and others, the most commonly used liner metals being copper, certain types of steel and aluminium. Upon detonation of the high explosive charge every liner element (the liner element being a ring cut of the liner) separates when reaching the liner axis of symmetry into two parts or streams, one flowing backwards and forming the slug and the other one bursting forward and forming the jet that penetrates the target. In order to achieve good penetration the jet must have a high tip velocity and a long break-up time and experience has shown that only light and medium weight metals of the kind mentioned hereinbefore meet these requirements.

At the same time it can also be shown that the penetration power of the jet would increase with the density of the liner, which increase, however, is incompatible with the need for a high tip velocity. Thus, for example, while with a copper liner a jet tip velocity of 9.5 km/sec. is achieved, heavy metal jets have tip velocities which are generally below 7 km/sec. The contribution of the fastest part of the jet to the penetration is large and especially important when the shaped charge is used at stand-offs as short as 2–3 charge diameters which are typical to almost all the weapons with shaped charge warheads used today.

PRIOR ART

It has already been proposed in the past to provide a heavy metal coating such as gold on the inner side of a liner in order to improve the penetration capacity thereof. These attempts were however unsuccessful and did not lead to a commercial product.

DESCRIPTION OF THE INVENTION

In accordance with the present invention it has now been found that the penetration capacity into a target of a jet resulting from the imploding liner of a shaped charge in consequence of the detonation of the high explosive charge, can be improved significantly by means of a heavy metal coating such as of tungsten, tantalum, uranium, gold, osmium, platinum, irridium or alloys of such metals, provided certain conditions are met.

In accordance with the invention there is provided a shaped charge bomb comprising a liner having on the inner side a coating of a metal whose density is greater than that of the liner ("heavy metal coating"), which coating extends from an inner end on a circumferential line of the liner that results from the intersection of the inner side of the liner with a notional cylinder coaxial with the liner and having a radius not exceeding R/4 where R is the inner radius of the liner, the thickness of the heavy metal coating at each point meeting the equation $$T_c\rho_c/\sin^2\frac{\beta}{2} < T_1\rho_1/\cos^2\frac{\beta}{2}$$

where $T_c$ is the coating thickness at a given circumferential line x, $T_1$ is the liner thickness, $\rho_c$ is the coating density, $\rho_1$ is the liner density and $\beta$ is the collapse angle at the circumferential line x.

The inner, narrow end of the liner may be an apex or a flattened end portion in case of a conical or frustoconical liner, or may have any other suitable shape, e.g. be trumpet shaped, and in any case a portion of the inner side of the liner must remain uncoated over an area which extends between the inner end liner of the coating and the inner end of the liner.

The collapse angle $\beta$ changes along the liner, increasing from the inner end towards the front end (base) thereof.

In accordance with one embodiment of the invention the heavy metal coating on the inner side of the liner is of uniform thickness in which case the thickness is determined by the smallest collapse angle $\beta$ prevailing at the inner end of the coating.

In accordance with another embodiment of the invention the heavy metal coating is graded with the thickness increasing commensurately with the collapse angle $\beta$ from the inner liner to the front end of the coating.

Experiments conducted in accordance with the invention have shown that by means of the invention the penetration power of a hollow charge liner jet into a target is improved significantly. Thus, for example, in case of a copper liner with a tungsten coating, the penetration capacity into a massive hard steel target of 320 BNH was improved by about 10%.

The heavy metal coating on the inner side of a shaped charge according to the invention can be produced by any of several methods all known per se, as described, for example, in Metals Handbook, 9th Edition, Vol. 5, published by the American Society for Metals, Metals Park, Ohio. Thus, for example, it is possible to employ chemical vapour deposition (CVD). By this method a copper liner is, for example, coated with tungsten by keeping the liner in an environment of gaseous $WF_6$. Hydrogen gas is injected into the $WF_6$ gas near the location where the liner is to be coated. Hydrogen replaces tungsten in the $WF_6$ gas forming the acid HF and the released tungsten atoms pile on the liner thus forming the coating. The process takes place in a specific, high temperature and the liner is revolved about its axis of symmetry to ensure axial symmetry of the coating. It is possible to control the form of the tungsten crystals by judiciously selecting the temperature, spinning rate of the liner and tungsten deposition rate, the latter being controlled by the hydrogen flow rate.

Another known coating method that can be employed for the purposes of the present invention is the so-called plasma powder coating method. In this method the liner is covered with metal powder particles which are shot against it in a hot inert gas jet. The powder jet hits the liner in a narrow area. The liner is revolved at a rate of a few hundred revolutions per minute during the process and the beam is slowly moved back and forth along its directrices whereby full coverage of the liner area is achieved. Because of the high temperature of the plasma jet the adequate cooling of the liner is very important to avoid its becoming distorted due to uneven local heating. The mass density of the coated layer achieved in this method is about 80–90% of the crystal density of the coating metal. The coating process is fast and cheap.

Yet another known method that can be employed in accordance with the invention is electrolysis. In this method the liner is immersed as an anode in a bath containing a dissolved salt of the metal with which it is to be coated, while a piece of the same metal serves as cathode. A DC current is passed through the liquid between the anode and cathode until a layer of suitable thickness of the metal is obtained on the liner. The coating by electrolysis has the advantage that the process takes place at room temperature and consequently no change is expected to occur in the metallurgical state of the carrier metal.

The invention also provides for the use as a liner in a bomb with a shaped charge warhead, an axially symmetrical hollow body of tapering shape made of sheet metal and having on its inner side a coating of a metal whose density is greater than that of the liner, which coating extends from a narrow end on a circumferential line of the liner that results from the intersection of the inner side of the liner with a notional cylinder coaxial with the liner and having a radius not exceeding R/4 where R is the inner radius of the front end of the liner, the thickness of the heavy metal coating meeting the equation.

$$T_c \cdot \rho_c/\sin^2\frac{\beta}{2} < T_l\rho_l/\cos^2\frac{\beta}{2}$$

where $T_c$ is the coating thickness at a given circumferential line x, $T_l$ is the liner body thickness, $\rho_c$ is the coating density, $\rho_l$ is the liner density and $\beta$ is the collapse angle of the operational liner at the circumferential line x.

The coating on the inner side of the liner forming the hollow body may be uniform or graded as specified.

DESCRIPTION OF THE FIGURES

The invention is illustrated, by way of example only, in the accompanying drawings in which:

FIG. 6 is a partial view of a shaped charge with one embodiment of a coated liner according to the invention;

FIG. 7 is a partial view of a shaped charge wth another embodiment of a coated liner according to the invention.

DESCRIPTION OF SOME PREFERRED EMBODIMENTS

Figure 1:
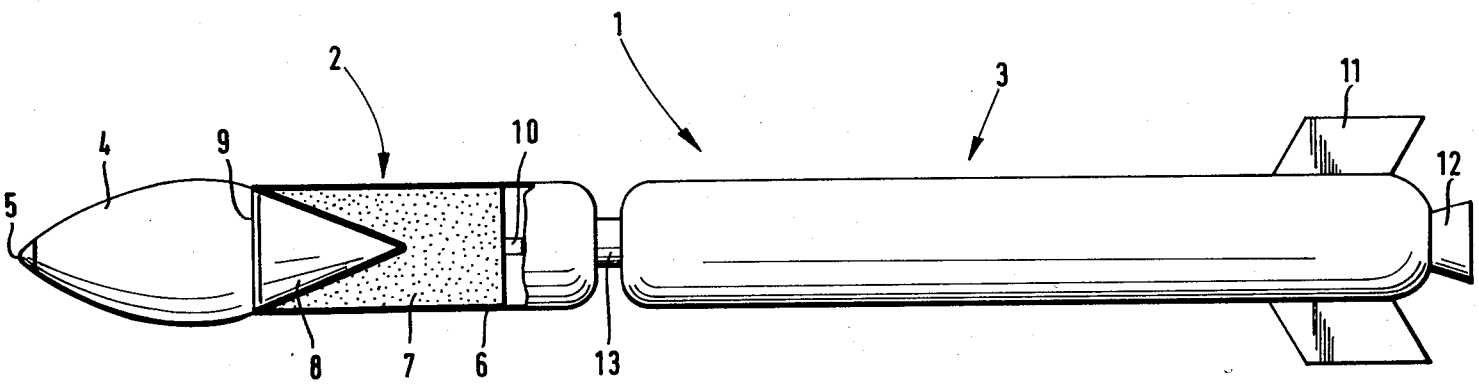
FIG. 1 is an elevation partly in section of a rocket fitted with a shaped charge warhead.

The rocket shown in FIG. 1 is a typical bomb with a shaped charge warhead. It comprises a front section 2 and a rear section 3, the front section 2 comprising an ogive 4 with a collapsible cap 5, a shaped charge warhead 6 comprising a high explosive charge 7 and a conical liner 8 having a front end (base) 9, the distance between base 9 and the tip of cap 5 being conventionally defined as the stand-off.

At its aft part section 2 comprises a fuse (not shown) and a detonator 10.

The rear section 3 houses a rocket motor (not shown) and its aft part comprises stabilizing wings 11 and a short exhaust pipe 12.

Sections 2 and 3 of missile 1 are connected by a connector piece 13.

The shaped charge warhead of rocket 1 is of conventional design and functions in a known manner. Thus, with firing of the rocket the fuse system loads itself, changing from off to on position. When thereupon the cap 5 of the ogive nose collapses upon hitting the target, the detonator 10 of the shaped charge is exploded, initiating the high explosive charge whereupon liner 8 implodes forming a forward bursting jet that penetrates the target.

Figure 2:
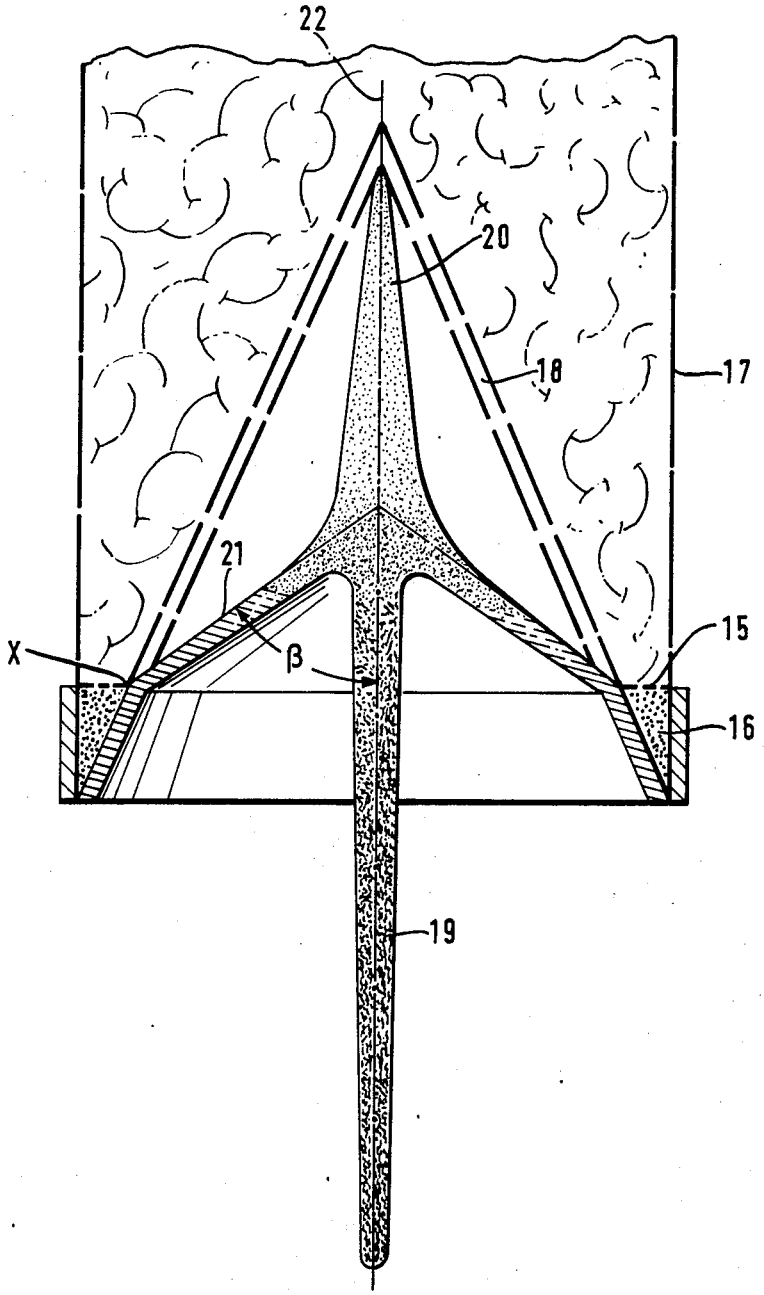
FIG. 2 is a diagrammatic illustration of the liner kinetics upon detonation of the shaped charge.

The kinetics of the transformation of the liner into a high velocity jet in consequence of the detonation of the high explosive charge are illustrated in FIG. 2. In that Figure contours of structural parts which were destroyed in consequence of the detonation are indicated in dashed lines showing the shape prior to detonation, while still existing parts are shown in solid lines. Furthermore, in FIG. 2 the dotted line 15 denotes the front of the advancing detonation of the high explosive charge 16.

As shown, in consequence of the detonation those parts of body 17 and liner 18 that are at the rear of the advancing detonation front 15 have been destroyed, the housing splinters having been scattered around while the liner has formed into a forward bursting, piercing jet 19 and into a rearward flowing slug jet 20.

As is further seen from FIG. 2, when liner 18 implodes in consequence of the action of the advancing detonation front 15 at a circular line x, the solid mass thereof is gradually converted into a coherent jet 19 and a slug jet 20 with the outer side 21 of the liner forming with the central axis 22 an angle $\beta$ which is defined as the collapse angle, the collapse angle $\beta$ increasing with the spread of liner 18 (for closer description and calculation of the collapse angle $\beta$ see, for example, Eitan Hirsch, locs. cit.)

All the foregoing description with reference to FIGS. 1 and 2 concerns prior art and is given merely for a better understanding of the invention.

Figure 3:
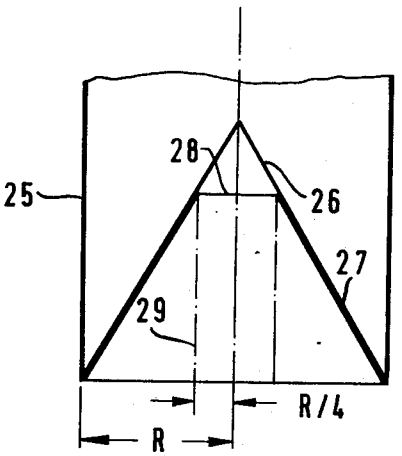
FIGS. 3–5 are diagrammatic representations illustrating the geometry of the coating.
Figure 4:
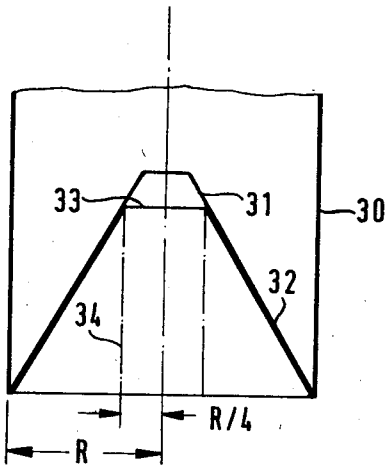
Figure 5:
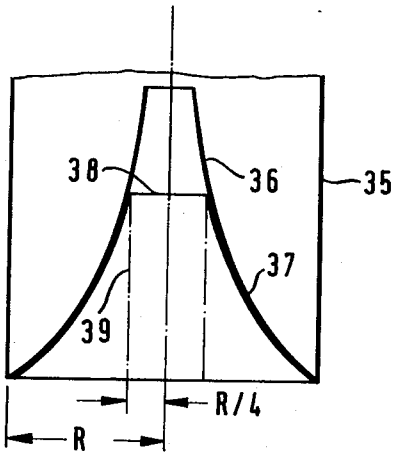

The geometry of the heavy metal coatings of a shaped charge liner according to the invention is shown in FIGS. 3–5. By referring first to FIG. 3 it is seen that a warhead housing 25 holds a conical liner 26 whose inner front end radius is R. Part of the inner side of the liner 26 is covered by a heavy metal coating 27 in accordance with the invention, which coating extends between an inner circumferential line 28 and the front end (base) of the liner. Line 28 is obtained by intersection between the inner side of liner 27 and a notional cylinder 29 whose radius does not exceed R/4.

In FIG. 4 the liner is frustoconical, the various parts being analogous to those of FIG. 3, comprising housing 30, liner 31, coating 32, inner end line 33 and notional cylinder 34.

In FIG. 5 the liner is trumpet shaped and the arrangement comprises housing 35, liner 36, coating 37, inner end line 38 and notional cylinder 39.

A first embodiment of a liner according to the invention is illustrated in FIG. 6. As shown, a warhead housing 41 holds a hollow charge 42 comprising a conical liner 43. On its inner side liner 43 comprises a coating 44 of a metal having a higher density than the metal of which the liner 43 is made. The coating extends up to an inner circumferential line 45 whose distance from apex 46 is determined in the manner specified and described with reference to FIGS. 3–5.

In the embodiment of FIG. 6 the coating 44 is of uniform thickness which is determined on the basis of the formula given hereinbefore with the collapse angle $\beta$ being the one that prevails at the circumferential line 45.

Upon detonation of the explosive charge 42, the liner 43 behaves in a manner similar to that described with reference to FIG. 2 with, however, the resulting jet corresponding to jet 19 of FIG. 2 having a higher penetration power than would have been the case without the coating.

In the embodiment of FIG. 7 a warhead housing 47 contains a hollow charge 48 comprising a liner 49. In this case the liner 49 is of frusto-conical shape comprising an inner, narrow end 50 and a front end (base) 51. Also in this case the inner face of liner 49 comprises a coating 52 whose density is higher than that of the metal of which the liner 49 is made. As in the previous case the coating extends between an inner circumferential line 53 which is removed from the inner end 50 by a distance determined in the manner specified and described with reference to FIGS. 3–5.

As distinct, however, from the embodiment of FIG. 6, in this case the thickness of the coating 52 increases gradually from end line 53 to the base 51 so that at each circumferential line the thickness of the coating is determined by the collapse angle $\beta$ there prevailing. In this way more coating mass can be added on the inner side of the liner with the result that the increase of the penetration capacity of the jet resulting upon detonation, is even higher than in the case of the embodiment of FIG. 6.

What is claimed is:

1. In a bomb comprising an axially extending shaped charge warhead section having an explosive charge having a surface defining a free space and an internal liner having a dimension that increases axially symmetrically from an inner apex or narrow end to a front end or base, the liner having an outer side facing the space-defining surface of the shaped explosive charge and an inner side facing away from the space-defining surface of the explosive charge, the improvement comprising:

a coating applied to the inner side of said liner formed of a metal having a density greater than the density of the material from which the liner is formed, said coating extending from an inner end to the front end or base of the liner, the inner coating end being defined by a circumferential line of the liner formed at the intersection of the inner side of the liner with a notional cylinder coaxial with the liner and having a radius not exceeding R/4 where R is the inner radius of the liner at its front end or base, the thickness of the coating at least at said inner end or at each point meeting the equation $$T_c \cdot \rho_c/\sin\frac{2\beta}{2} < T_1 \cdot \rho_1/\cos\frac{2\beta}{2}$$

where $T_c$ is the coating thickness at a given circumferential line x, $T_1$ is the liner thickness, $\rho_c$ is the coating density, $\rho_1$ is the liner density and $\beta$ is the collapse angle at the circumferential line x.

2. A bomb according to claim 1 wherein the coating is of uniform thickness determined on the basis of the collapse angle $\beta$ prevailing at the inner end of the coating.

3. A bomb according to claim 1 wherein the coating is graded with the thickness increasing commensurately with the collapse angle $\beta$ from the inner end to the front end of the coating.

4. For use as a liner in a bomb with a shaped charge warhead, an axially symmetrical hollow body of tapering shape having a dimension that increases from an inner apex or narrow end toward a base end, the hollow body being made of sheet metal and having an outer side and an inner side, a coating applied to the inner side of said liner formed of a metal having a density greater than the density of the metal from which the liner is formed, the coating extending from an inner end to said base end, said inner end being defined by a circumferential line of the liner formed at the intersection of the inner side of the liner with a notional cylinder coaxial with the liner and having a radius not exceeding R/4 where R is the inner radius of the liner at its base end, the thickness of the coating at least at said inner end or at each point meeting the equation $$T_c \cdot \rho_c/\sin\frac{2\beta}{2} < T_1 \cdot \rho_1/\cos\frac{2\beta}{2}$$

where $T_c$ is the coating thickness at a given circumferential liner x, $T_1$ is the liner body thickness, $\rho_c$ is the coating density, $\rho_1$ is the liner density and $\beta$ is the collapse angle of the operational liner at the circumferential line x.

5. A body according to claim 4 wherein the coating is of uniform thickness determined on the basis of the collapse angle $\beta$ prevailing at the inner end of the coating.

6. A body according to claim 4 wherein the coating is graded with the thickness in increasing commensurately with the collapse angle $\beta$ from the narrow end to the front end of the coating.

* * * * *